US008006738B2

(12) United States Patent
Takahashi

(10) Patent No.: US 8,006,738 B2
(45) Date of Patent: Aug. 30, 2011

(54) WINDOW UP-AND-DOWN-WINDING-TYPE SHIELDING APPARATUS FOR CONVEYANCE

(75) Inventor: Daisuke Takahashi, Itabashi Ward (JP)

(73) Assignee: TOK Bearing Co., Ltd., Tokyo (JP)

( * ) Notice: Subject to any disclaimer, the term of this patent is extended or adjusted under 35 U.S.C. 154(b) by 155 days.

(21) Appl. No.: 12/354,395

(22) Filed: Jan. 15, 2009

(65) Prior Publication Data

US 2009/0288347 A1 Nov. 26, 2009

(30) Foreign Application Priority Data

May 22, 2008 (JP) ..... 2008-134033

(51) Int. Cl.
*E06B 9/60* (2006.01)

(52) U.S. Cl. ..... 160/297; 160/291

(58) Field of Classification Search ..... 160/274, 160/287, 290.1, 305, 291, 297, 275
See application file for complete search history.

(56) References Cited

U.S. PATENT DOCUMENTS 503,037 A * 8/1893 Crisson ..... 160/274
516,603 A * 3/1894 King ..... 160/274
636,123 A * 10/1899 Emery ..... 160/274
1,033,224 A * 7/1912 Andlauer ..... 160/274
5,887,637 A * 3/1999 Phyper ..... 160/274

* cited by examiner

*Primary Examiner* — Blair M. Johnson

(74) *Attorney, Agent, or Firm* — Wenderoth, Lind & Ponack, L.L.P.

(57) ABSTRACT

A window up-and-down-winding-type shielding apparatus for a conveyance includes: a pair of guide rails that are parallel to each other and that extend in an up-and-down direction; a moving member that is connected to a lower end of a shielding member and that can be moved in the up-and-down direction along the guide rails; a winding mechanism that has a rotation section for retractably winding the shielding member; a biasing force application device that applies a biasing force to the rotation section of the winding mechanism in a direction along which the shielding member is wound; a motion conversion mechanism that converts the movement of the moving member in up-and-down direction along the guide rails to a rotational motion; and an axis member that is coordinated with the motion conversion mechanism to have a rotational motion in accordance with the up-and-down movement of the moving member. The axis member is connected to a mechanism for switching a direction along which the rotative force is transmitted.

4 Claims, 15 Drawing Sheets

B-B

C-C

WINDOW UP-AND-DOWN-WINDING-TYPE SHIELDING APPARATUS FOR CONVEYANCE

BACKGROUND OF THE INVENTION

The present invention relates to a window up-and-down-winding-type shielding apparatus for a conveyance such as an electric train, a train, a bus, or a passage boat. Conventionally, shading curtains attached to a window part of a conveyance such as an electric train, a train, or a bus in particular include a lateral manual curtain, a curtain in which the lower end of the curtain is pulled from the top side to the lower side to hook hook parts formed at the lower ends, of the curtain to hook concave sections at the lateral sides of the window, and a free-stop-type longitudinal roll screen.

The above lateral manual curtain has a disadvantage in that an end part of the window partially blocks light entering the window when the curtain is opened and is not used to block light and this end part disturbs the view and also causes a poor appearance.

The above curtain in which the curtain is retained by hooking the hook parts cannot be retained in a nonstep manner because the curtain can be retained only at positions at which the hook concave sections are formed. This curtain also has a disadvantage in that the curtain must be raised and lowered by both hands.

The above free-stop-type longitudinal roll screen can be retained in a nonstep manner but always requires a troublesome operation to open the roll screen by holding the handles at the lowermost end of the roll screen to push up the roll screen, which is disadvantageous.

It is an objective of the present invention to solve the above disadvantages.

SUMMARY OF THE INVENTION

The present invention is a window up-and-down-winding-type shielding apparatus for a conveyance that has a shielding member movable in an up-and-down direction for forming a shading screen at a window part of the conveyance and that causes the shielding member to be moved in the up-and-down direction to adjust a shading range of the window part. This apparatus includes: a pair of guide rails that are provided at both sides of the window part of the conveyance and that extends in the up-and-down direction so as to be parallel to each other; a moving member that is supported by the guide rails along the guide rails so as to be movable in the up-and-down direction and that is connected to a lower end of the shielding member; a winding mechanism that has a rotation section for retractably winding the shielding member at an upper end of the guide rail; a biasing force application means that applies a biasing force to the rotation section of the winding mechanism in a direction along which the shielding member is wounded; a motion conversion mechanism that converts the movement of the moving member in the up-and-down direction along the guide rails to a rotational motion; an axis member that is coordinated with the motion conversion mechanism to have a rotational motion in accordance with the up-and-down movement of the moving member; and a mechanism for switching a direction along which the rotative force is transmitted by which the rotation of the axis member in one direction is allowed and the rotation of the axis member in other directions is limited and the free rotation direction and the limited rotation direction can be switched.

Also according to the present invention, the motion conversion mechanism is composed of a rack gear formed to be parallel to the guide rail and a pinion gear meshed with the rack gear. Also according to the present invention, the motion conversion mechanism is composed of a rail face of the guide rail and a pulley that contacts with the rail face and that is rotated by a frictional force in accordance with the up-and-down movement of the moving member along the guide rail.

Also according to the present invention, an impact-absorbing means is provided that absorbs an impact by collision at an end at which the winding of the shielding member is completed between the moving member and a side at which the elevation of the moving member is stopped.

The up-and-down-winding-type shielding apparatus of the present invention can be operated very easily due to the following structure. Specifically, for a shielding operation, a handle at the lowermost end of the shielding member can be operated to descend the shielding member for shielding. Then, this operation may be stopped at an arbitrary position at which the pulled-out shielding member is fixed. For an opening operation (i.e., for an operation to store the shielding member) on the other hand, the handle at the lowermost end of the shielding member can be held to slightly elevate the handle to smoothly elevate the shielding member to the most-opened position (i.e., storage position).

DETAILED DESCRIPTION OF THE INVENTION

Hereinafter, embodiments of the present invention will be described with reference to the attached drawings.

Figure 1:
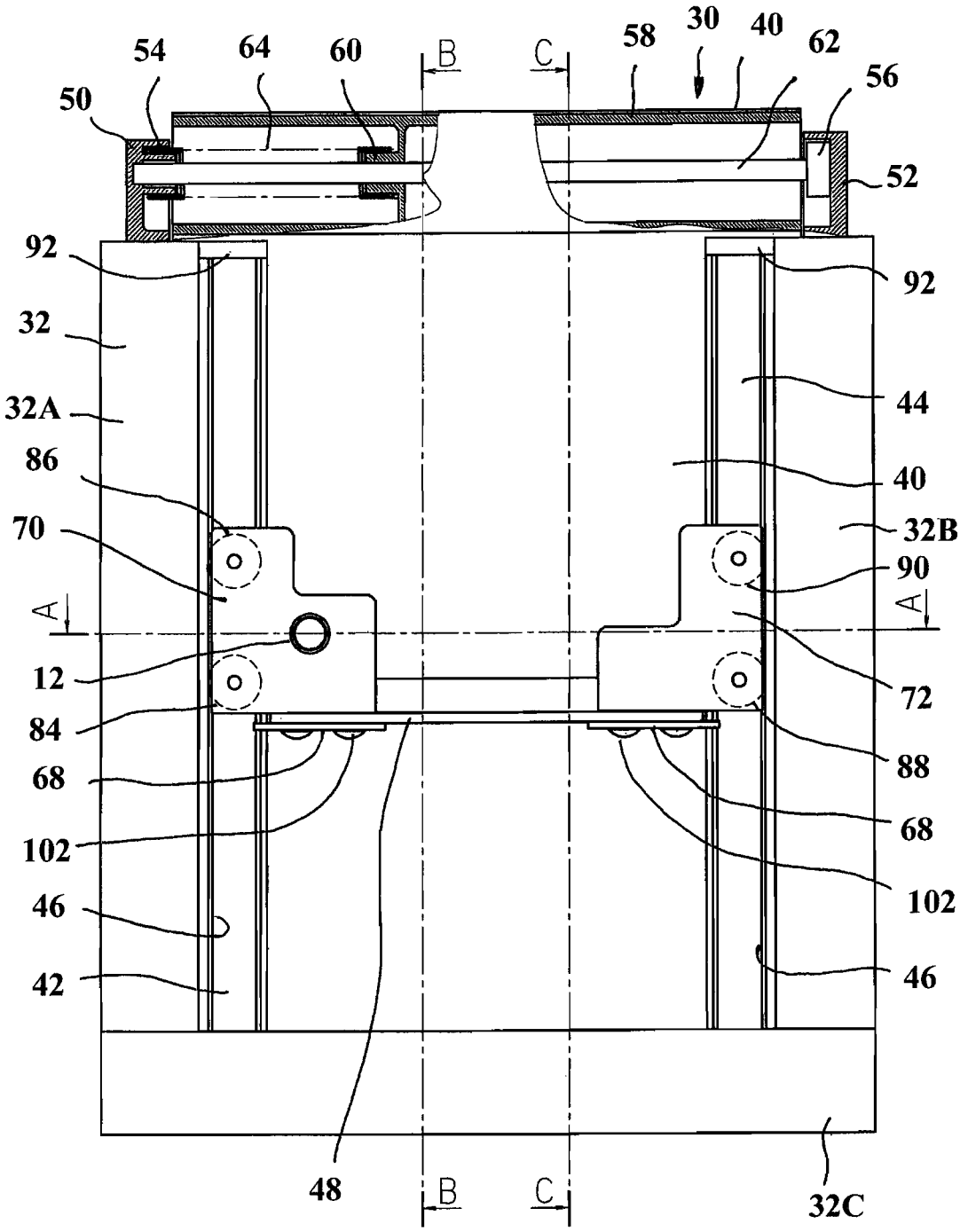
FIG. 1 is a back view illustrating the entirety of a window up-and-down-winding-type shielding apparatus for a conveyance according to the present invention.
Figure 2:
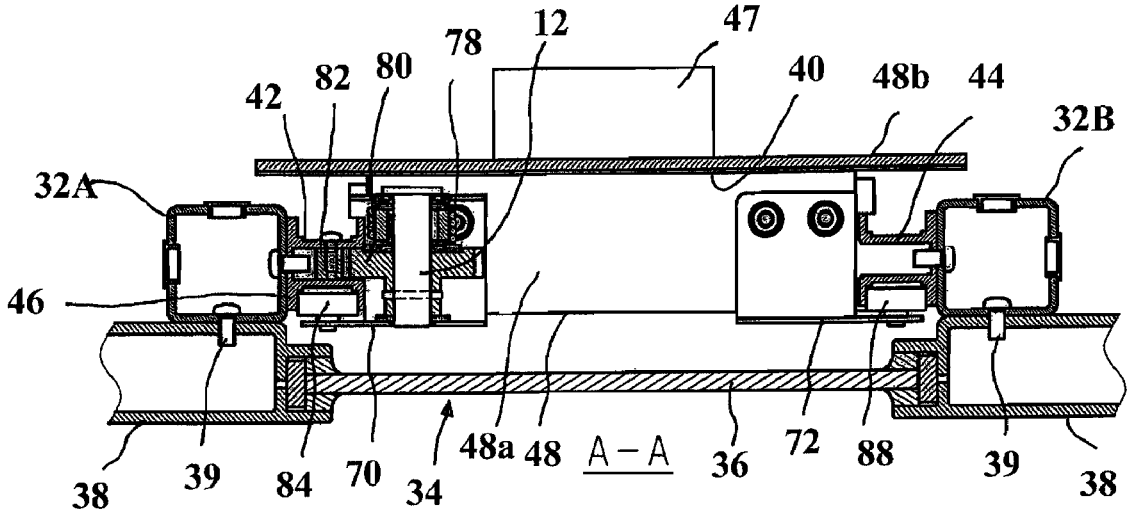
FIG. 2 is a cross-sectional view of the window up-and-down-winding-type shielding apparatus for a conveyance according to the present invention taken along the line A-A.
Figure 3:
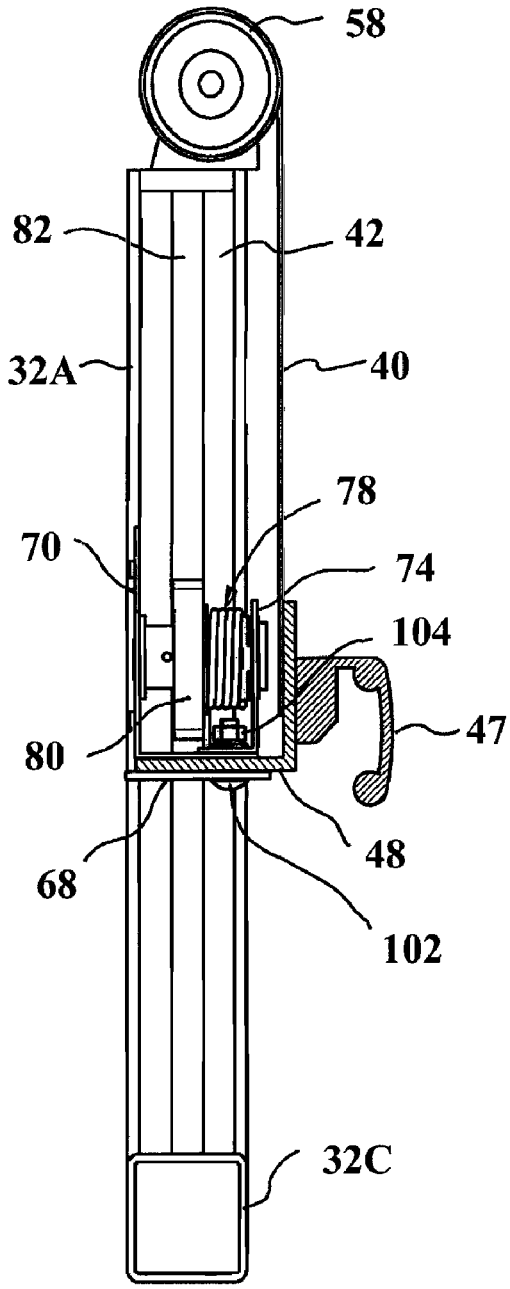
FIG. 3 is a cross-sectional view of the window up-and-down-winding-type shielding apparatus for a conveyance according to the present invention taken along the line B-B.
Figure 4:
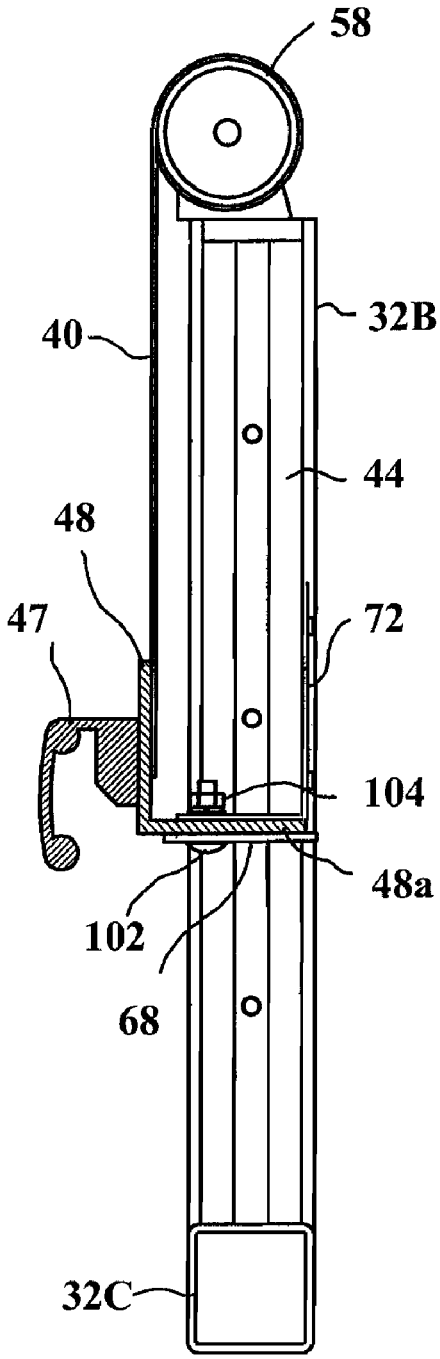
FIG. 4 is a cross-sectional view of the window up-and-down-winding-type shielding apparatus for a conveyance according to the present invention taken along the line C-C.

FIG. 1 is a back view illustrating the entirety of a window up-and-down-winding-type shielding apparatus 30 for a conveyance such as an electric train, a train, a bus, or a passage boat according to the present invention. This apparatus 30 has a frame 32 that consists of side frames 32A and 32B provided at the left and right sides and a connecting frame 32C provided between the lower ends of the side frames 32A and 32B. As shown in FIG. 2, the frame 32 is fixed by a screw 39 to a frame 38 supporting a window glass 36 of a window 34 of a conveyance such as an electric train, a train, a bus, or a passage boat. A screen-like shielding member 40 that can be moved in the up-and-down direction is provided to face the window glass 36. The window 34 for a conveyance to which this apparatus 30 is attached may be the openable one in which the window glass part can be slid in the up-and-down direction or the fixed one in which the window glass part cannot be opened and closed. The frame 32 of this apparatus 30 also maybe integrated to the frame 38 of the window 34. In FIG. 1 and FIGS. 3 and 4, the window 34 of the conveyance is not shown. Side faces opposed to each other of the side frames 32A and 32B are fixed with guide rails 42 and 44 by screws, respectively. The back faces of the guide rails 42 and 44 have roller guides 46 having a concave cross section along the longitudinal direction, respectively. The roller guides 46 have roller guide faces 46*a* and 46*b* opposed to each other.

The guide rails 42 and 44 have therebetween a moving member 48. The moving member 48 extends in a direction orthogonal to the guide rails 42 and 44 and consists of a plate member having an L-like cross section. This moving member 48 has a handle 47. At the upper ends of the side frames 32A and 32B, brackets 50 and 52 are fixed, respectively. One bracket 50 has a pipe-like bearing 54 and the other bracket 52 has a fixed oil damper 56. The upper parts of the side frames 32A and 32B have therebetween a winding roller 58 provided in the horizontal direction. The inner circumference face of the cylindrical section of the winding roller 58 has a fixed pipe-like bearing 60.

The bearing 60 has a rotation axis 62 fixed at the center of the winding roller 58. One end of the rotation axis 62 is rotatably supported by the bearing 54 and the other end thereof is connected to a rotation section of the oil damper 56 (not shown). The rotation axis 62 has a coil spring 64 (biasing force application means) for biasing the winding that is freely fitted. Both ends of the coil spring 64 are engaged with the outer circumference faces of the bearings 54 and 60 and are locked by the bearings 54 and 60, respectively.

A shielding member 40 is wound around the outer circumference face of the winding roller 58. The shielding member 40 is composed of a flexible screen member having sheet-like shape and blocks the light coming through the window 34 of the conveyance. One end of the inner side of the shielding member 40 is locked by the winding roller 58. The rotation axis 62, a bearing mechanism for rotatably supporting the rotation axis 62, and the winding roller 58 constitute a winding mechanism that retractably winds the shielding member 40 at the upper ends of the guide rails 42 and 44. At both sides of the lower face of a horizontal section 48*a* of the moving member 48, guide plates 68 are provided, respectively. At the upper face corresponding to the lower face, the first support plates 70 and 72 having an L-like shape are provided, respectively.

Figure 5:
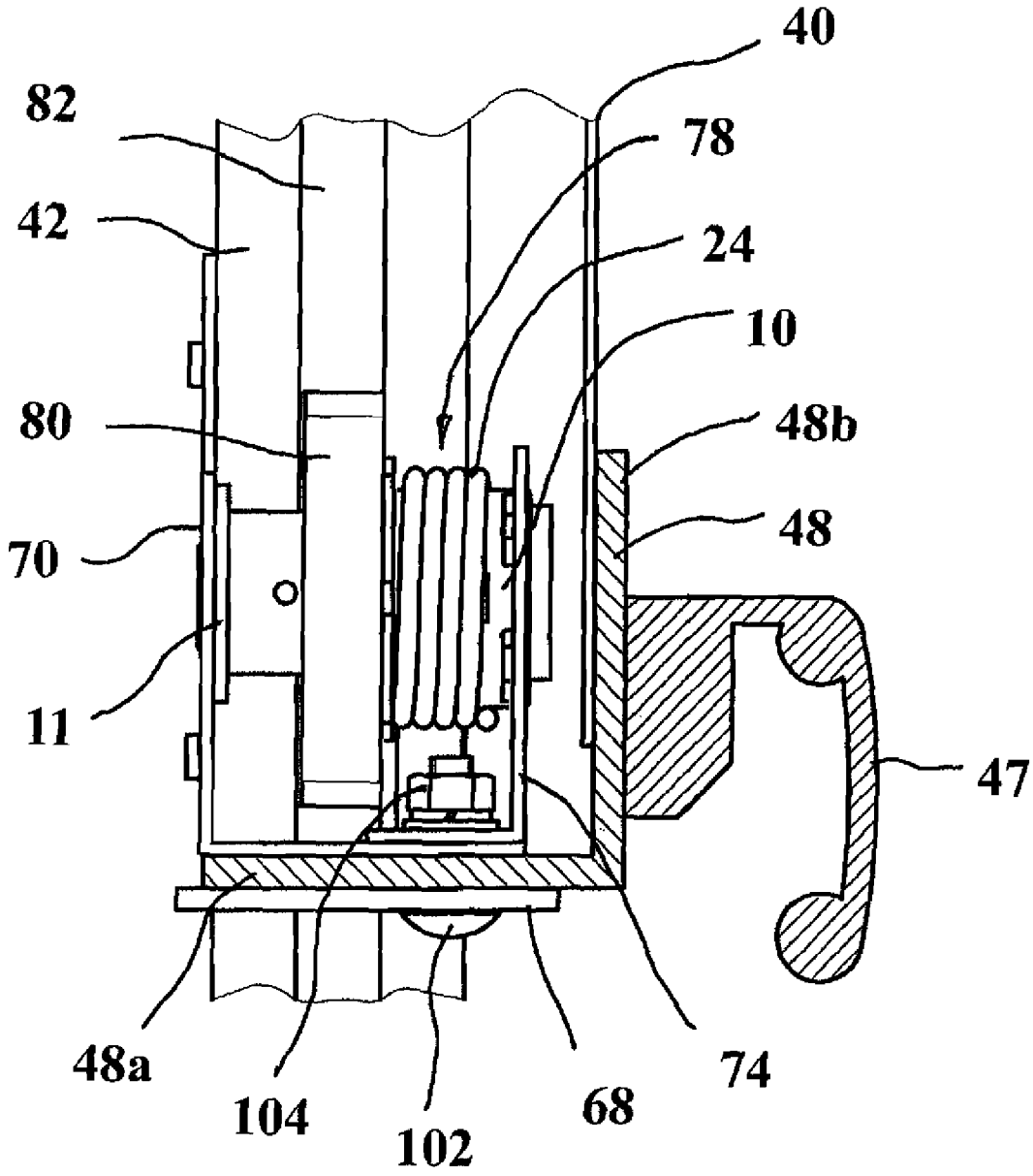
FIG. 5 is a cross-sectional view illustrating the main part of the window up-and-down-winding-type shielding apparatus for a conveyance according to the present invention.
Figure 6:
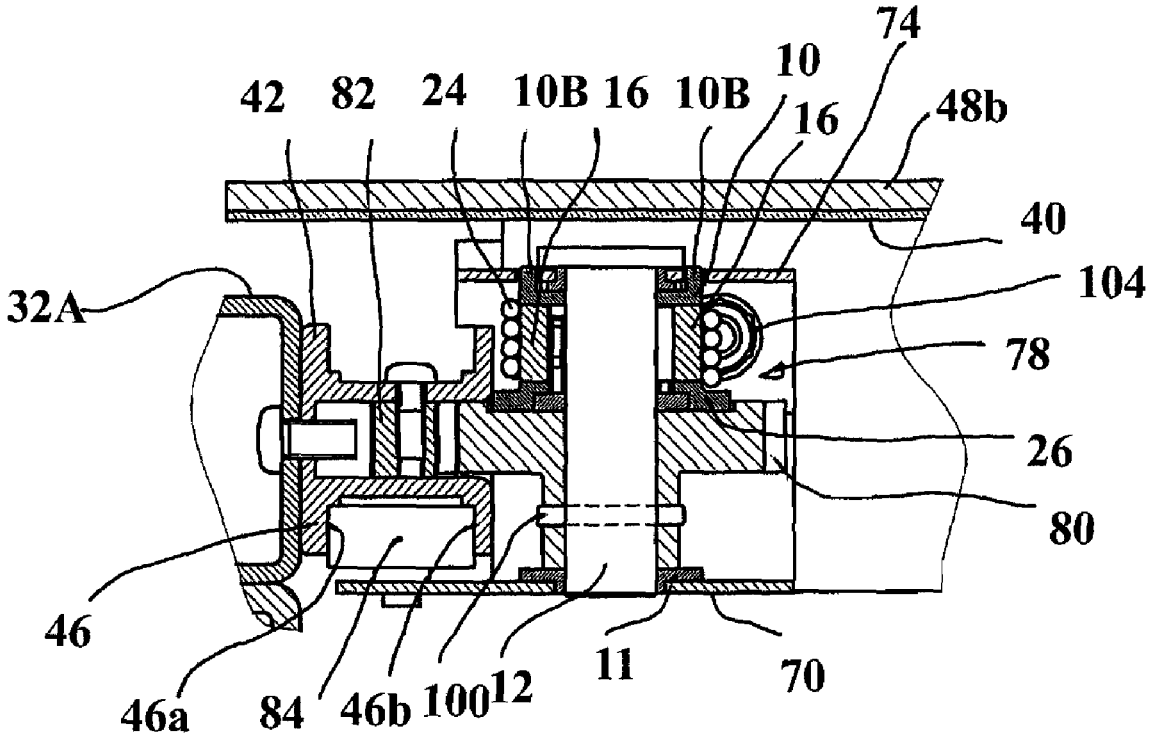
FIG. 6 is a cross-sectional view illustrating the main part of the window up-and-down-winding-type shielding apparatus for a conveyance according to the present invention.
Figure 7:
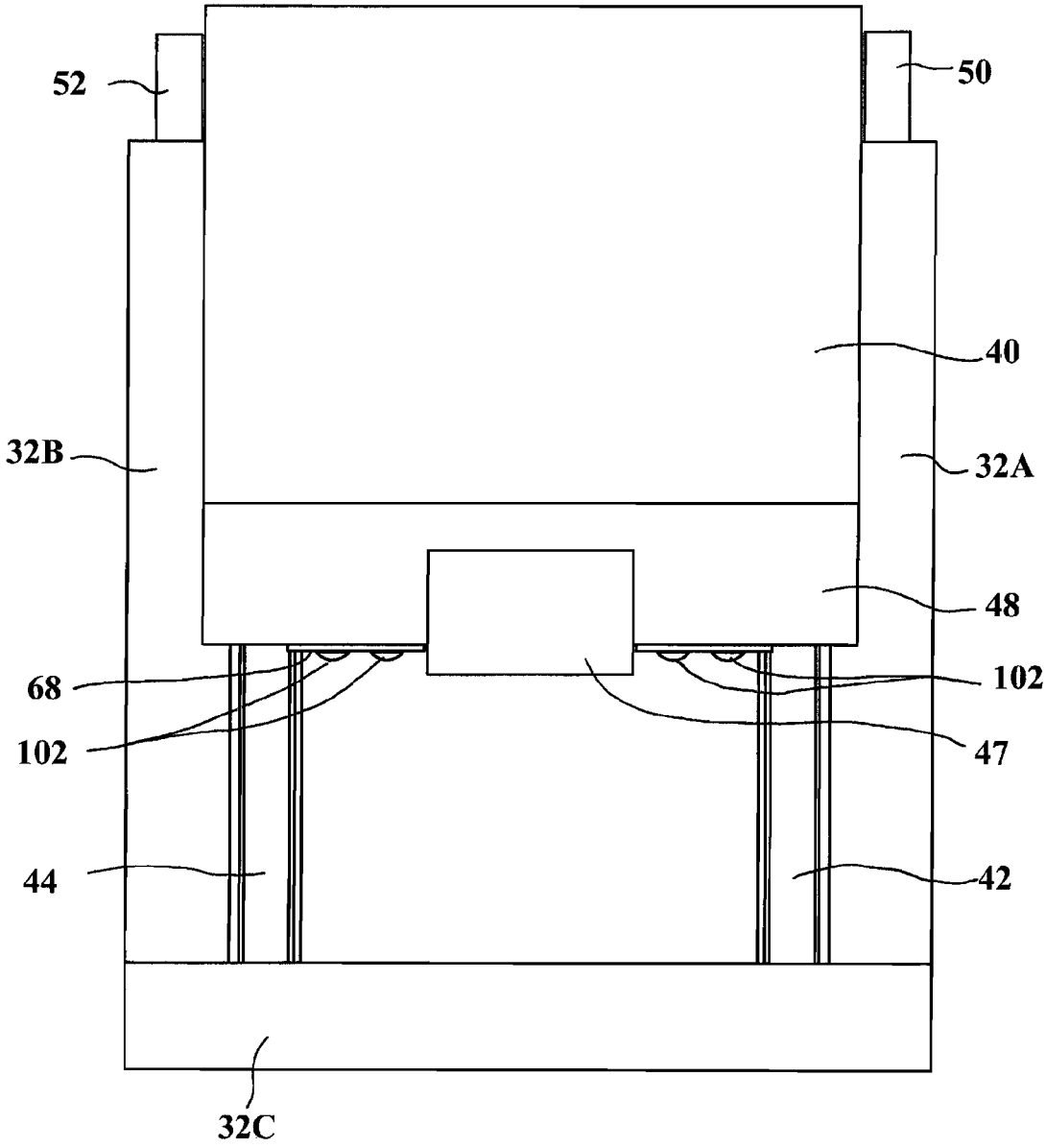
FIG. 7 is a front view illustrating the entirety of the window up-and-down-winding-type shielding apparatus for a conveyance according to the present invention.

Among the first support plates 70 and 72, the first support plate 70 is provided as shown in FIG. 5 so that the horizontal sections of the first support plate 70 and the second plate 74 having an L-like shape are superposed. The first support plate 70, the second support plate 74, and the guide plate 68 are fixed by a screw 102 and a nut 104 to the horizontal section 48a of the moving member 48. The raised section of the first support plate 70 and the second support plate 74 support, via a base member 10 and a bearing member 11, both ends of an axis member 12 in a rotatable manner, as shown in FIG. 6.

The axis member 12 has a bidirectional clutch 78 attached thereto and has a fixed pinion gear 80. The pinion gear 80 is meshed with a rack gear 82 that is fixedly provided in the guide rail 42 along the longitudinal direction. The first support plate 72 at the other side of the moving member 48 and a guide plate 68 are fixed by a locking tool consisting of the screw 102 and the nut 104 to the upper face of the horizontal section 48*a* of the moving member 48 as shown in FIG. 4.

The first support plates 70 and 72 at the left and right sides of the moving member 48 respectively have pairs of rollers 84, 86, 88, and 90 that are axially supported in a rotatable manner in the up-and-down direction. The respective rollers 84, 86, 88, and 90 are rotatably engaged with and guided by the respective roller guide faces 46*a* and 46*b* of rail grooves 46 formed in the longitudinal direction of the guide rails 42 and 44. The guide plates 68 are slidably abutted to the rail faces formed in the longitudinal direction of the guide rails 42 and 44 to guide the moving member 48 in a straight direction along the longitudinal direction of the guide rails 42 and 44.

As shown in FIG. 5, the raised section 48*b* of the moving member 48 is connected to the lower end of the shielding member 40. When the handle 47 of the moving member 48 is held by a hand to move the moving member 48 in the up-and-down direction between the side frames 32A and 32B, the shielding member 40 can be pulled out from the winding roller 58 to the space between the side frames 32A and 32B against the winding spring force of the coil spring 64 to pull out the shielding member 40 to the lower side or to elevate the shielding member 40 to the upper side.

Next, the configuration of the bidirectional clutch 78 will be described with reference to FIG. 8 to FIG. 15.

The bidirectional clutch 78 constitutes a mechanism for switching a direction along which the rotative force is transmitted. This mechanism allows the rotation of the axis member 12 in one direction and limits the rotation of the axis member 12 in other directions and can switch the free rotation direction and the limited rotation direction. To carry out the present invention, the switching mechanism is not limited to the structure of a bidirectional clutch as will be described below and can use various conventionally-known bidirectional clutch structures.

Figure 8:
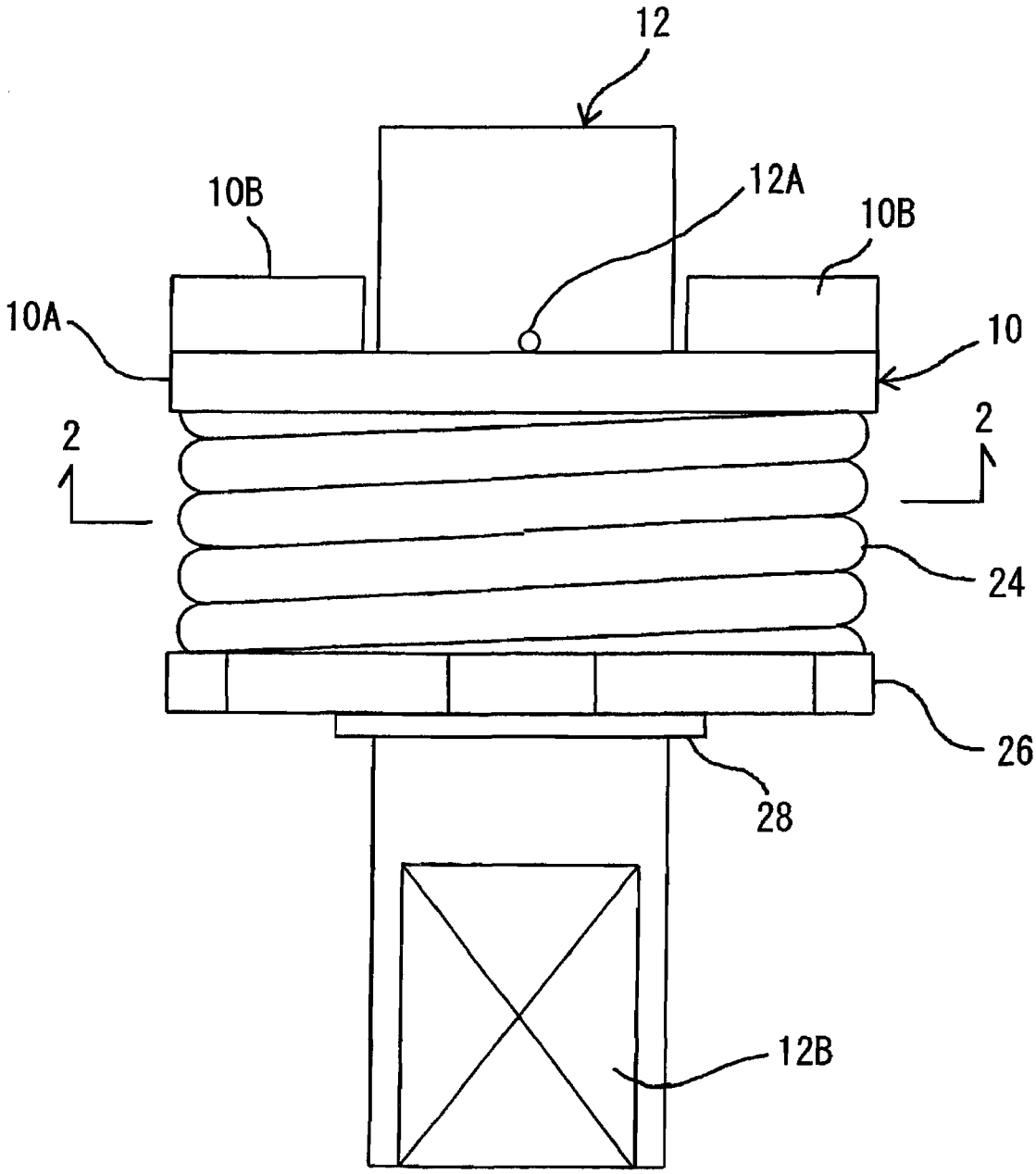
FIG. 8 is a side view illustrating the first embodiment of a bidirectional clutch.
Figure 12:
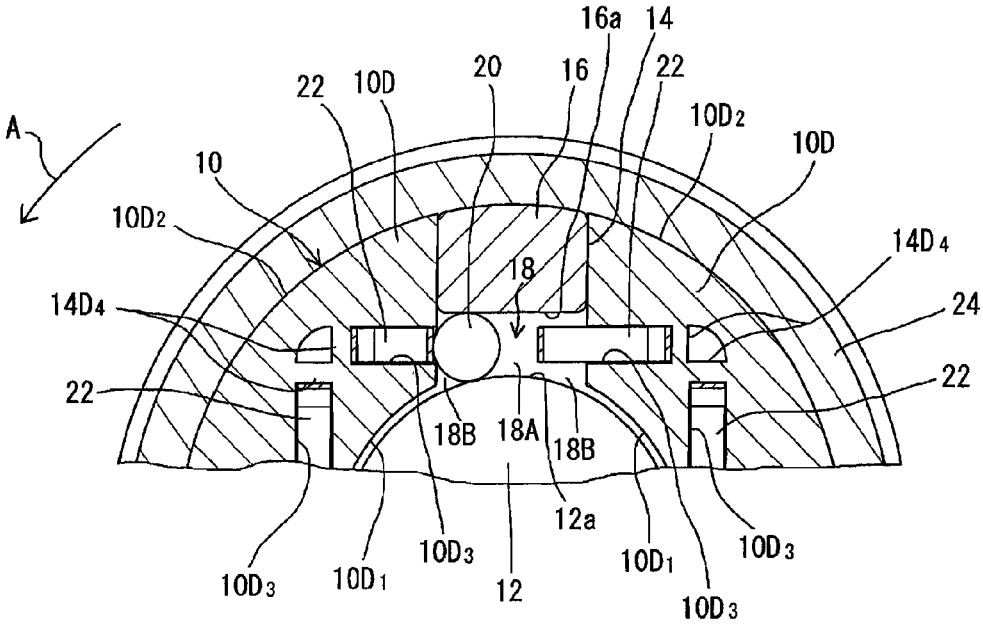
FIG. 12 is a partial enlarged view of FIG. 9.

As shown in FIG. 8 or FIG. 12, the bidirectional clutch has a base member 10. This base member 10 is made of appropriate metal or resin material.

The base member 10 has an annular body 10A. The outer face of the body 10A in the axis direction has a pair of protrusions 10B (see FIG. 8 and FIG. 10) in the radial direction. This protrusion 10B is a protrusion to attach the bidirectional clutch to a partner member in the mechanism (i.e., the support plate 74) in a non-rotatable manner.

Figure 10:
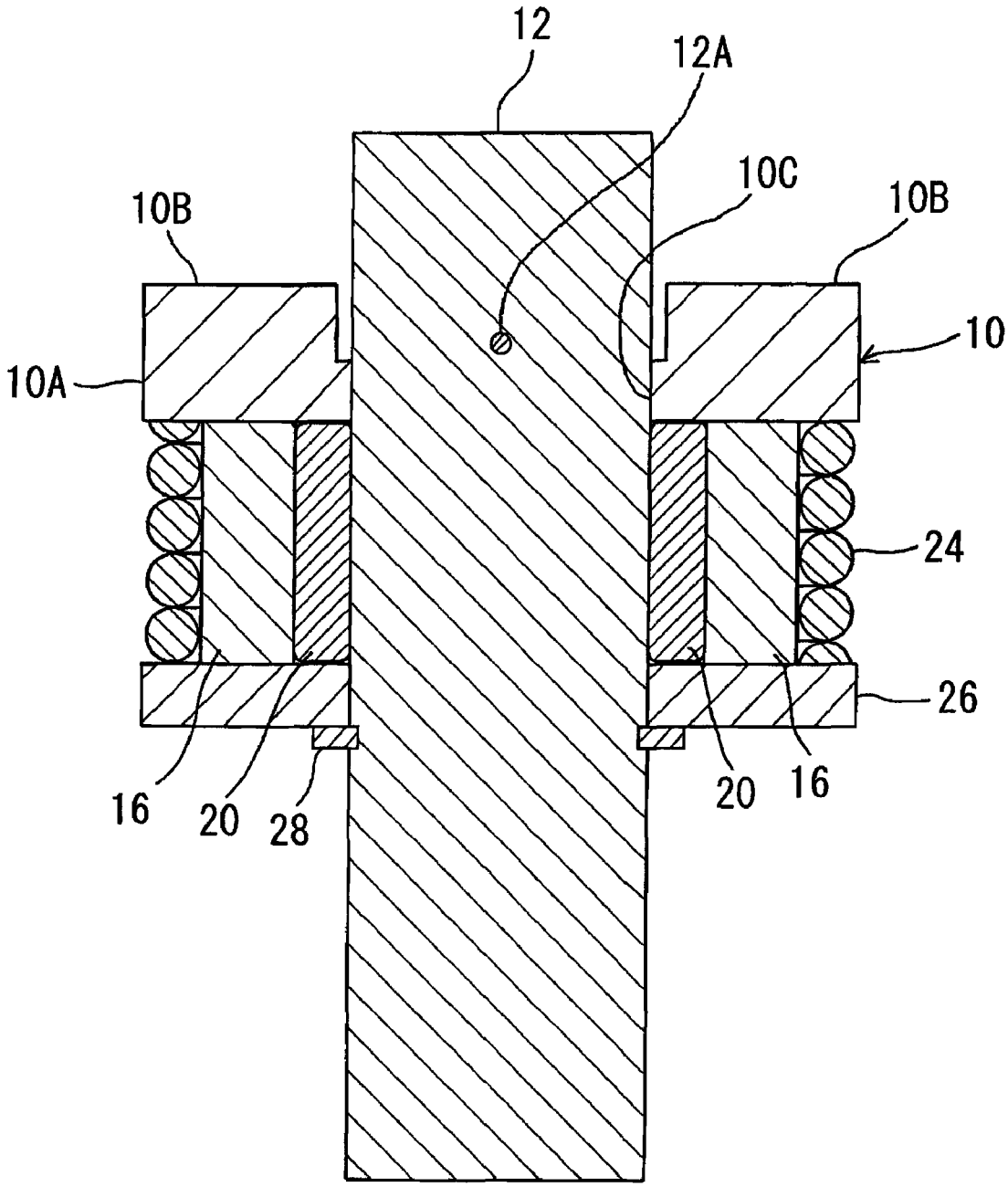
FIG. 10 is a cross-sectional view taken along the line 3-3 of FIG. 9.

As shown in FIG. 10, the center of the base member body 10A has a hole 10C through which the axis member 12 is inserted rotatably. As shown in FIG. 8, one end of the axis member 12 has a stopper pin 12A that penetrates the axis member 12. This stopper pin 12A prevents the base member body 10A from being disengaged from the end of the axis member 12.

Figure 9:
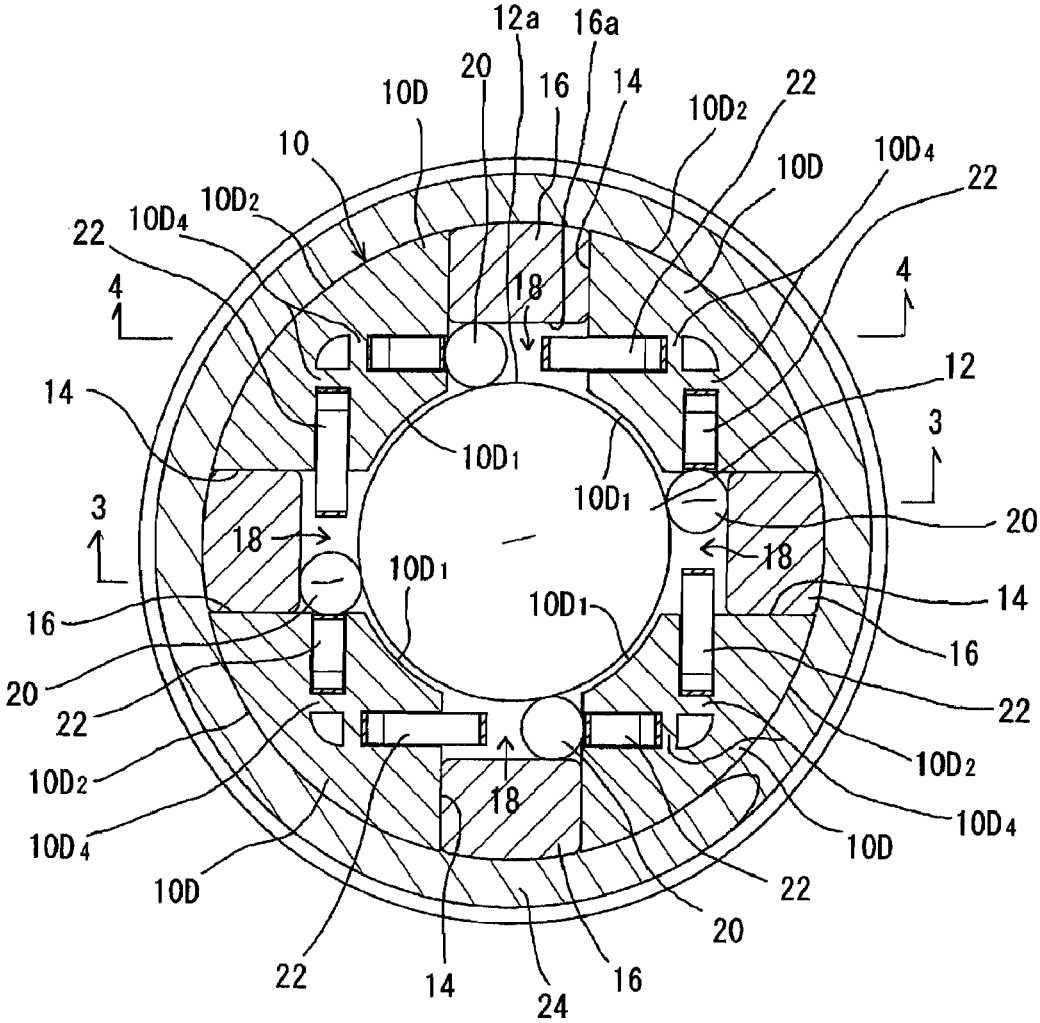
FIG. 9 is a cross-sectional view taken along the line 2-2 of FIG. 8.

As shown in FIG. 8 and FIG. 10, the other end of the axis member 12 has a flat face 12B formed to have a D-like cross section for example. This other end is connected by the flat face 12B to the pinion gear 80 in an integrated and rotatable manner. The axis member 12 also may be connected to the pinion gear 80 by a penetration pin 100 as shown in FIG. 6. As shown in FIG. 9, the annular base member 10 also has a retainer 10D that is provided at the inner side of the body 10A in an integrated manner so as to be parallel to the axis member 12.

This retainer 10D has a fan-like cross section and is provided at three or more positions and are formed at four positions in the shown embodiment. These fan-like retainers 10D are provided in the circumference direction of the axis member 12 with an equal interval. The respective retainers 10D include curved inner faces 10D1 extending along the outer circumference face of the axis member 12 and curved outer faces 10D2 extending along the outer face of the annular the base member body 10A.

The respective curved inner faces 10D1 are formed by a concentric circle slightly larger than a circle forming the outer circumference face of the axis member 12. The respective curved outer faces 10D2 are formed by a concentric circle slightly smaller than a circle forming the outer circumference face of the annular the base member body 10A.

As shown in FIG. 9, the two neighboring retainers 10D have therebetween a guide path 14 extending in the radial direction of the axis member 12. At the openings at the inner ends in the radial direction of the respective guide paths 14, the outer circumference face of the axis member 12 is exposed. As shown in FIG. 9 and FIG. 10, the bidirectional clutch according to the present invention also includes piece members 16 slidably stored along the respective guide paths 14 in the radial direction. The respective piece members 16 have inner faces in the radial direction that are composed of flat faces orthogonal to the faces in the radial direction of the axis member 12. These inner faces cooperate with the outer circumference face of the axis member 12 and the left and right side faces of the retainer 10D to form a space 18.

The piece member 16 is made of high hardness metal and is made of iron-base sintered material in this illustrative embodiment. The piece member 16 also may be made of high hardness metal such as carbonitrided and hardened steel material. The material constituting the piece member 16 is not limited to metal and also may be any high hardness material such as ceramic or resin so long as the material has a sufficiently-high hardness by which the piece member 16 can be durable during the use. The bidirectional clutch also includes a needle 20 that is a rolling member stored in the space 18.

The length of the axis member 12 of this needle 20 in the axis line direction is substantially the same as the length of the piece member 16 as shown in FIG. 10.

As shown in FIG. 12 in detail, the inner face of the piece member 16 in the radial direction is composed of a flat face orthogonal to the face of the axis member 12 in the radial direction. The outer circumferential face of the axis member 12 on the other hand is a curved surface of a perfect circle. Thus, the space 18 has, at the center thereof, a narrow section 18A having the shortest distance between the inner face of the piece member 16 in the radial direction and the outer circumferential face of the axis member 12. Both sides of the narrow section 18A have expanded sections 18B that are provided to surround the axis member 12 and that are formed to have an inverse tapered shape. In the narrow section 18A, the distance between the inner face of the piece member 16 in the radial direction and the outer circumferential face of the axis member 12 is smaller than the diameter of the needle 20.

In the expanded section 18B, the distance between the inner face of the piece member 16 in the radial direction and the outer circumferential face of the axis member 12 is larger than the diameter of the needle 20.

Figure 11:
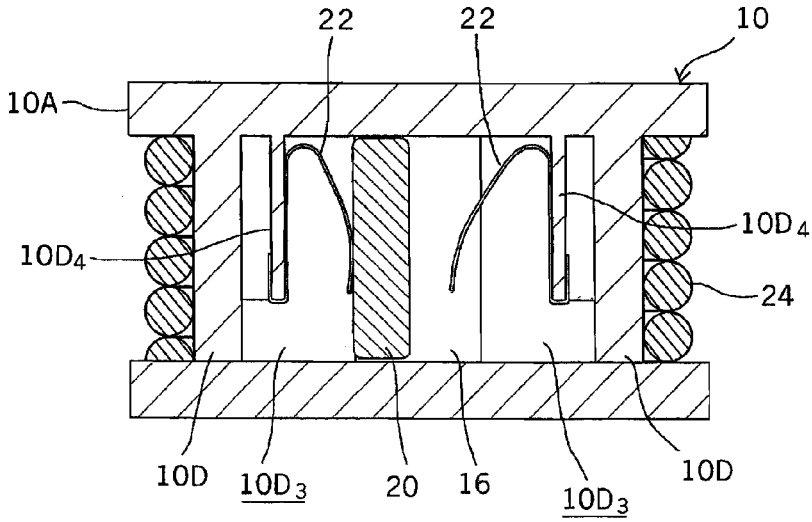
FIG. 11 is a cross-sectional view taken along the line 4-4 of FIG. 9.

As shown in FIG. 11 and FIG. 12, the side faces opposing to each other of the two fan-like retainers 10D neighboring to each other (i.e., side faces forming the guide path 14) have grooves 10D3 (see FIG. 11) that are provided in a vertical direction to the side faces. As shown in FIG. 11, the inner sides of the respective grooves 10D3 have partitions 10D4 integrated with a base member body 10A.

As shown in FIG. 9, FIG. 11, and FIG. 12, plate springs 22 are attached to the partitions 10D4 formed at the inner sides of the respective grooves 10D3. Each of the plate springs 22 is bent so that one end is attached to a free end of the partition 10D4 and the other end is bent to extend in the expanded section 18B of the space 18. The plate springs 22 are provided in the space 18B and functions as a means for elastically biasing the needle 20 toward the narrow section 18A. The existence of this plate spring 22 can more securely provide the braking operation of the needle 20 to the axis member 12. The biasing means to the needle 20 is not limited to a plate spring and may be any means currently-known in the field so long as the means can generate a resilient force.

As shown in FIG. 8 or FIG. 12, the bidirectional clutch also has a coil spring 24 that is wound around the outer curved faces 10D2 of the four fan-like retainers 10D. This coil spring 24 functions as a means to elastically bias the four piece members 16 to the axis member 12. The biasing means to piece member 16 is not limited to a coil spring and may be any means so long as the means can be attached to surround the outer curved face 10D2 of the retainer 10D and that can generate a resilient force.

Figure 15:
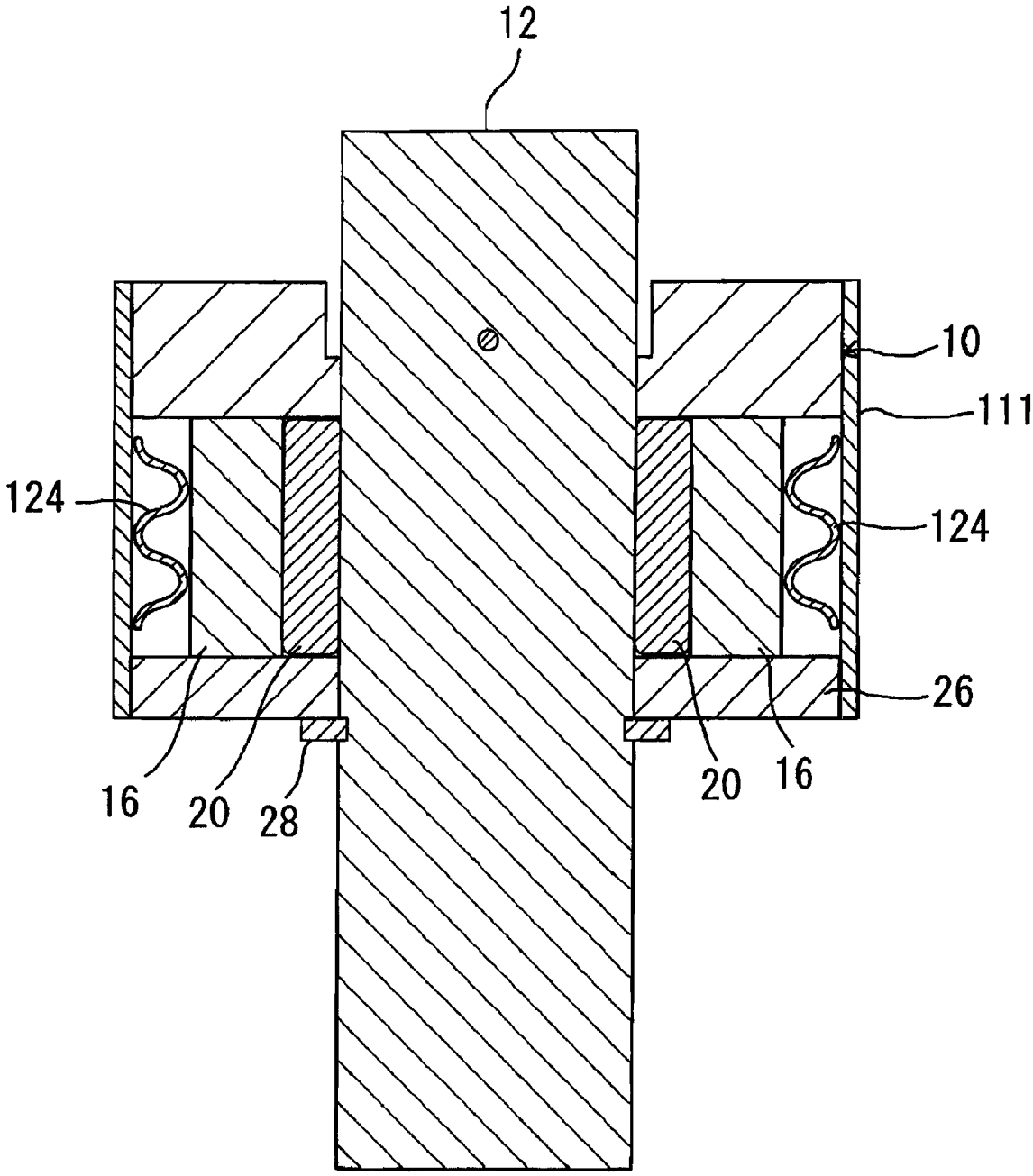
FIG. 15 is a cross-sectional view illustrating an alternative of a biasing means to a piece member and corresponding to FIG. 10.

For example, the biasing means to piece member 16 also may be a plate spring that has a C-like cross section and that has a substantially-cylindrical shape. The biasing means to the piece member 16 also can be provided for each piece member. For example, as shown in FIG. 15, cylindrical-shaped housings 111 also may be provided so as to surround the base member 10, the fan-like the retainer 10D, and a retention plate 26 (which will be described later) and each of the inner circumferential faces of the housings 111 and each of the outer faces of the piece members 16 have therebetween a plate spring 124 bent to have a wave-like shape. The plate springs 124 are used to elastically bias the respective piece members 16 toward the axis member 12.

In any case, the biasing means to the piece member 16 can be appropriately selected from among biasing means known in the field. As shown in FIG. 8 and FIG. 10, the bidirectional clutch further includes the retention plate 26 that cooperates with the base member body 10A to sandwich the piece member 16, the needle member 20 and the coil spring 24 and that prevents the piece member 16, the needle member 20 and the coil spring 24 from being disengaged in the axis direction. This retention plate 26 is retained at a predetermined position by a detachable stopper 28 such as an E-ring.

Next, with reference to FIG. 12, the operation of the bidirectional clutch as described above will be described. In the status shown in FIG. 12, the moving member 48 is at the uppermost elevated position and the needle 20 of the bidirectional clutch is at the expanded section 18B in one side of the space 18 shown in FIG. 12 (left side in FIG. 12). In FIG. 12, when the moving member 48 is pulled down and the pinion gear 80 is rotated in the direction shown by the arrow A, the axis member 12 is also rotated in the same direction. In accordance with this, the needle 20 is moved in the same direction as that shown by the arrow A (i.e., the counterclockwise direction in FIG. 12) against the biasing force by the plate spring 22 while being rolled in the clockwise direction in FIG. 12. However, the movement of the needle 20 is hindered by the side faces of the fan-like retainers 10D. Then, the needle 20 idles in the expanded section 18B having a distance in the radial direction larger than the diameter of the needle 20.

When the moving member 48 moves from the open position to a fixed shielding position to stop the descending operation of the moving member 48, then the action by the restoring resilient force of the winding of the coil spring 64 generates a force for returning the moving member 48 in the upward direction that acts on the axis member 12. Then, the axis member 12 is rotated in the direction opposite to the direction shown by the arrow A of FIG. 12. In accordance with this, the needle 20 is moved to the narrow section 18A in the direction opposite to the direction shown by the arrow A while being rolled in the counterclockwise direction in FIG. 12. In the narrow section 18A, the distance between the outer circumferential face of the axis member 12 and the inner face of the piece member 16 in the radial direction is smaller than the diameter of the needle. Thus, in accordance with the rotation of the axis member 12, the needle 20 is inserted to the narrow section like a sliding door while being rolled to apply a braking force to the axis member 12. As a result, the moving member 48 and the shielding member 40 connected to the moving member 48 are retained at which the descending operation is stopped. In order to pull down the moving member 48 again, the same operation as the one as described above can be repeated to stop and retain the moving member 48 at an arbitrary position.

Next, in order to elevate the moving member 48, an operation is required to use a hand to pull up the moving member 48 with a predetermined force or more. This force depends on the resilient force of the coil spring 24 that allows the piece member 16 to move to the outer side in the radial direction and is equal to or higher than the resilient force. When a torque acting on the axis member 12 in the direction opposite to the direction shown by the arrow A of FIG. 12 is equal to or higher than the predetermined value determined by the elastic force of coil spring 24, the needle 20 expands the narrow section 18A against the elastic force of coil spring 24 to move the piece member 16 to the outer side in the radial direction of the axis member 12.

When the piece member 16 is moved to the outer side, the needle 20 is moved to the expanded section 18B at the opposite side over the narrow section 18A (the right side in FIG. 12). In the expanded section 18B at the right side in FIG. 12, no resistance to the movement of the needle is generated. Thus, the moving member 48 can be smoothly returned to the uppermost elevated position by the winding force of the winding roller 58. When the moving member 48 is desired not to be elevated to the uppermost elevated position and is desired to be elevated to an arbitrary position lower than the uppermost elevated position, the moving member 48 in the above elevation process may be pulled down in the descending direction to the arbitrary position to move the needle 20 to the expanded section 18B at the opposite side as described above to cancel the pull-down force at the position (i.e., to release the hand from the moving member 48). Consequently, the moving member 48 is stopped and retained at the arbitrary position.

Figure 13:
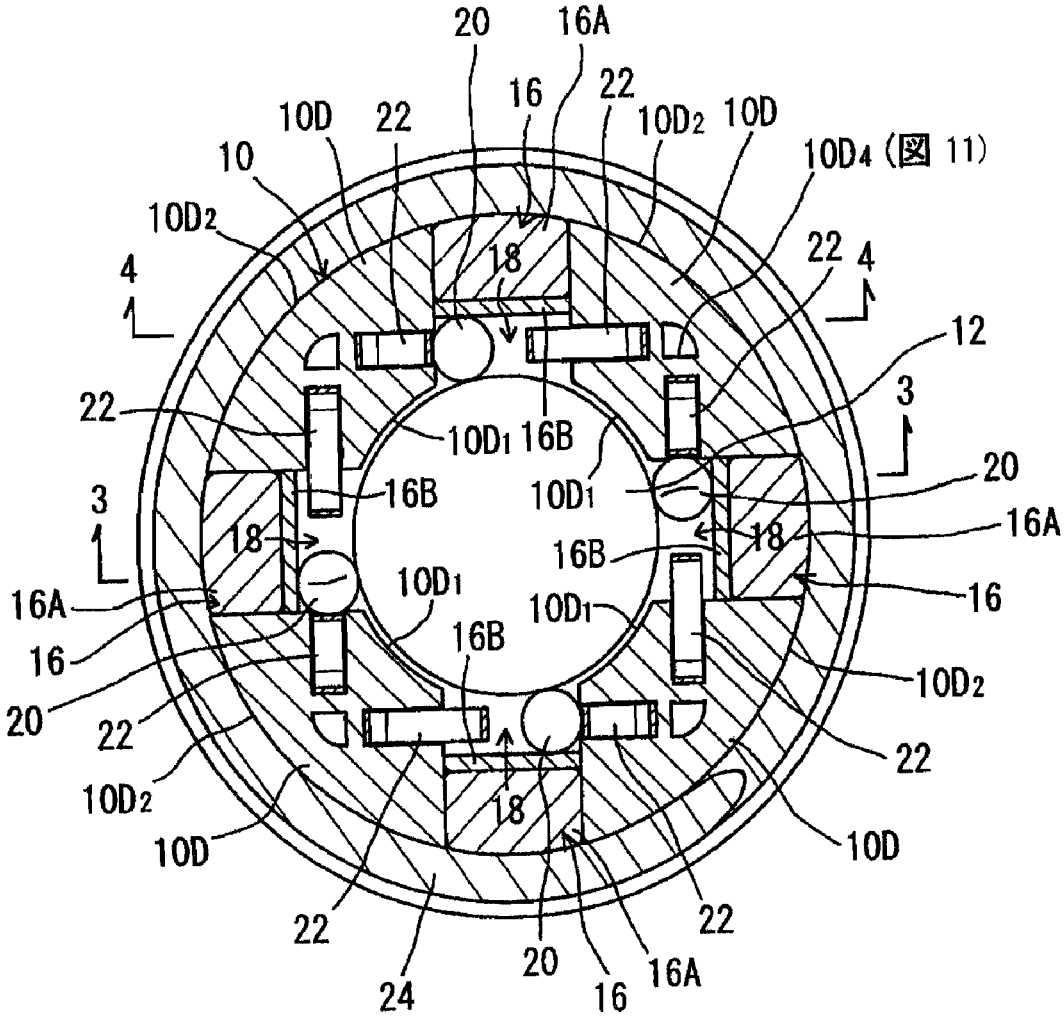
FIG. 13 is a cross-sectional view illustrating the second embodiment of bidirectional clutch and corresponding to FIG. 9.
Figure 14:
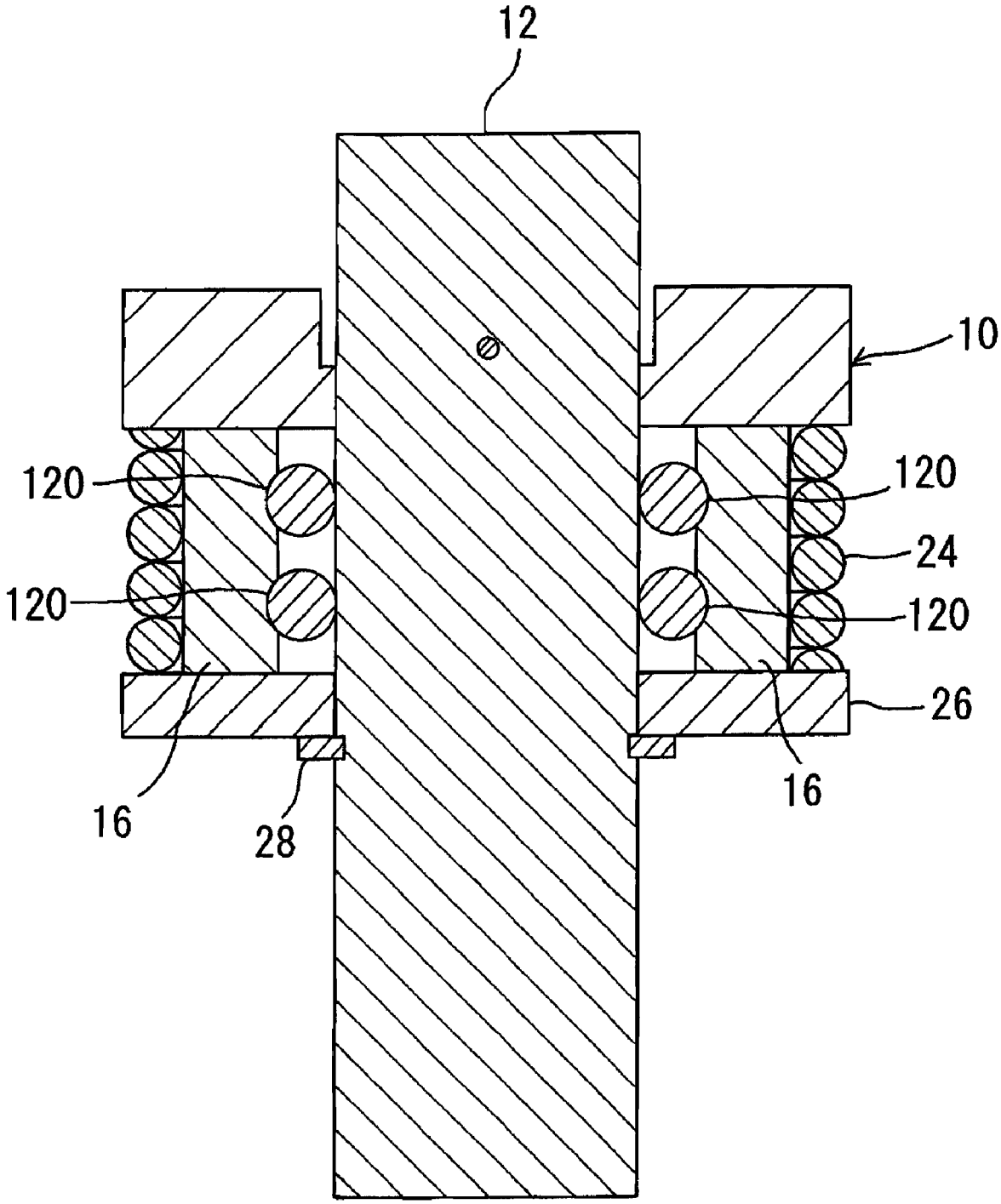
FIG. 14 is a cross-sectional view illustrating the third embodiment of bidirectional clutch and corresponding to FIG. 10.

Next, with reference to FIG. 13 corresponding to FIG. 9 the second embodiment of the bidirectional clutch will be described.

The second embodiment is the same as the first embodiment 1 except for a change in the configuration of the piece member 16. Specifically, in the second embodiment, the piece member 16A is made of resin having a low hardness. The inner face in the radial direction of the low hardness piece member 16A and the needle 20 have therebetween a plate member 16B made of high hardness material. This plate member 16B is preferably made of high hardness material such as iron-base sintered metal. This plate member 16B also may be made of carbonitrided and hardened steel material. This plate member 16B also may be made of ceramic or resin material having a sufficiently-high hardness.

Alternatively, the piece member in this second embodiment also may be provided as a complex composed of a low-hardness section 16A made of low-hardness resin material and a high-hardness section 16B that is made of high hardness material and that is provided at the inner face in the radial direction of the low-hardness section 16A in an integrated manner.

In the first and second embodiments as described above, when it is securely guaranteed that the needle 20 is rolled in accordance with the rotation of the axis member 12 and is placed in the narrow section 18A, then the needle biasing means (i.e., the plate spring 22) may be omitted.

In the first and second embodiments as described above, the four fan-like retainers 10D were provided so as to divide the inner face-side of base member body 10A by the guide path 14 extending in the cross direction to four parts and the total of four piece members 16 were used for the respective guide paths 14. However, the number of the fan-like retainers 10D, the guide paths 14, and the piece members 16 are not limited to them and may be provided in an amount of three or more to provide a stable operation of the bidirectional clutch. The fan-like retainers 10D, the guide paths 14, and the piece members 16 are preferably provided around the axis member 12 with an equal interval. Next, with reference to FIG. 14, the third embodiment of the bidirectional clutch will be described.

The third embodiment is the same as the embodiment shown in FIG. 10 except for a change in the rolling member. Specifically, in the third embodiment, the rolling member 120 is composed of, instead of the needle in the embodiment of FIG. 10, a plurality of balls arranged in the axis direction (two balls in the shown example). This embodiment can be advantageously used to further reduce the manufacture cost.

In the above up-and-down operation of the moving member, the moving member 48 also functions as a handle means. An operator can pull down or push up the moving member 48 by one hand. When the moving member 48 is elevated by the winding force of the winding roller 58 and reaches the uppermost end, then rollers 86 and 90 of the moving member 48 collide with an impact-absorbing member 92 that is provided at the upper ends of the guide rails 42 and 44 and that is made of urethane rubber for example. This mitigates the impact by the collision of the moving member 48 with the side at which the moving member 48 is locked at an end at which the winding of the shielding member 40 is completed.

Furthermore, the damper force by an oil damper 56 acts on the rotation of the rotation axis 62 in accordance with the up-and-down movement of the moving member 48 to allow the moving member 48 to move, without being suddenly moved, in the up-and-down direction by an external operation force or a winding elevation force. The above impact-absorbing member 92 constitutes an impact-absorbing means that absorbs the impact between the moving member 48 and the side at which the elevation of the moving member 48 is stopped at an end at which the winding of the shielding member 40 is completed. This impact-absorbing means is not particularly limited to the shown configuration in which the upper ends of the guide rails 42 and 44 have the impact-absorbing member 92 and is not limitedly provided to the side at which the winding of the shielding member 40 is locked. This impact-absorbing means also may be provided to the moving member 48.

Figure 16:
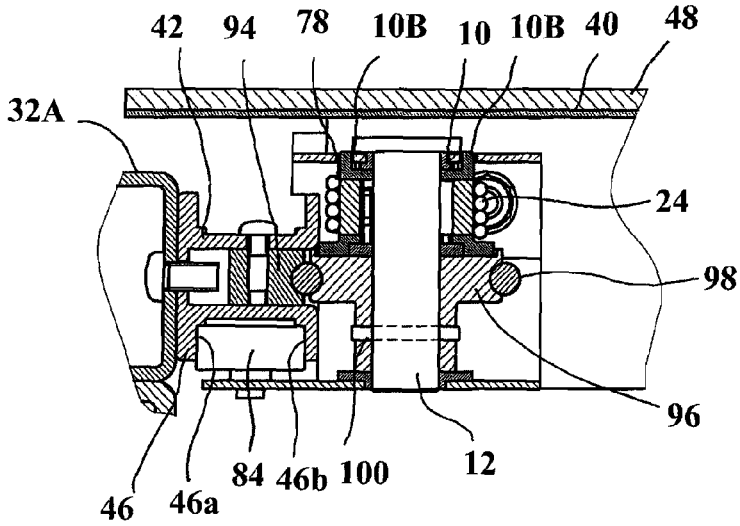
FIG. 16 is a cross-sectional view illustrating the main part of another embodiment of the present invention.
Figure 17:
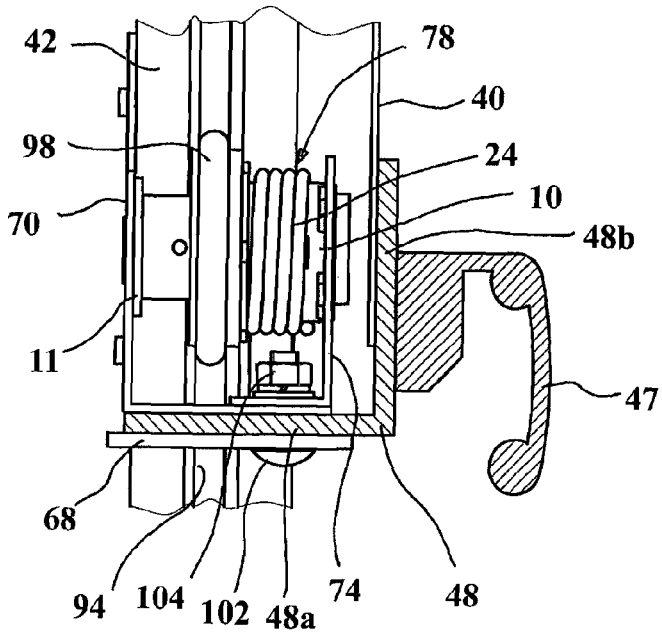
FIG. 17 is a cross-sectional view illustrating the main part of another embodiment of the present invention.

The impact-absorbing means also may be provided between the moving member 48 and a side at which the descending movement of the moving member 48 is stopped. The motion conversion mechanism to convert the up-and-down movement of the moving member 48 to a rotational motion to transmit this rotational motion to the axis member 12 of the bidirectional clutch is not particularly limited to the configuration of the rack gear 82 and the pinion gear 80 shown in FIG. 6. The motion conversion mechanism also may be a frictional force transmission mechanism, as shown in FIG. 16 and FIG. 17, where a guide rail in which a rail member 94 provided at a guide rail 42-side has a curved cross section is abutted with the outer circumference face of a friction pulley 96 fixedly attached to the axis member 12 via a rubber ring 98 so that the pulley 96 is rotated in the reverse direction in accordance with the up-and-down movement of the moving member 48. The other components of the embodiment shown in FIG. 16 and FIG. 17 are the same as those in the embodiment shown in FIG. 5 and FIG. 6.

The invention claimed is:

1. A window up-and-down-winding-type shielding apparatus for a conveyance that has a shielding member movable in an up-and-down direction for forming a shading screen at a window part of the conveyance and that causes the shielding member to be moved in the up-and-down direction to adjust a shading range of the window part, the window up-and-down-winding-type shielding apparatus comprising:

a pair of guide rails that are provided at both sides of the window part of the conveyance and that extends in the up-and-down direction so as to be parallel to each other;

a moving member that is supported by the guide rails along the guide rails so as to be movable in the up-and-down direction and that is connected to a lower end of the shielding member;

a winding mechanism that has a rotation section for retractably winding the shielding member at an upper end of the guide rails;

a biasing force application means that applies a biasing force to the rotation section of the winding mechanism in a direction along which the shielding member is wound;

a motion conversion mechanism that converts the movement of the moving member in the up-and-down direction along the guide rails to a rotational motion; and a two-direction clutch that includes an axis member and that is capable of switching between a free rotation direction where rotation of the axis member in one direction is allowed and a limited rotation direction where the rotation of the axis member in other direction is limited, wherein the two-direction clutch is attached to the moving member and the axis member included in the two-direction clutch is coordinated with the motion conversation mechanism to have a rotational motion in the accordance with the up-and-down movement of the moving member.

2. The window up-and-down-winding-type shielding apparatus for a conveyance according to claim 1, wherein the motion conversion mechanism is composed of a rack gear formed to be parallel to the guide rail and a pinion gear meshed with the rack gear.

3. The window up-and-down-winding-type shielding apparatus for a conveyance according to claim 1, wherein the motion conversion mechanism is composed of a rail face of the guide rail and a pulley that contacts with the rail face and that is rotated by a frictional force in accordance with the up-and-down movement of the moving member along the guide rail.

4. The window up-and-down-winding-type shielding apparatus for a conveyance according to claim 1, further comprising:

an impact-absorbing means that absorbs an impact by collision at an end at which the winding of the shielding member is completed between the moving member and a side at which the elevation of the moving member is stopped.

* * * * *